US009908326B2

(12) United States Patent
Holstun et al.

(10) Patent No.: US 9,908,326 B2
(45) Date of Patent: Mar. 6, 2018

(54) ENHANCING TEMPERATURE DISTRIBUTION UNIFORMITY ACROSS A PRINTER DIE

(71) Applicant: HEWLETT-PACKARD DEVELOPMENT COMPANY, L.P., Houston, TX (US)

(72) Inventors: Clayton L Holstun, San Marcos, CA (US); Kelly Ronk, Vancouver, WA (US); James A Feinn, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/304,603

(22) PCT Filed: Apr. 24, 2014

(86) PCT No.: PCT/US2014/035278

§ 371 (c)(1),
(2) Date: Oct. 17, 2016

(87) PCT Pub. No.: WO2015/163881

PCT Pub. Date: Oct. 29, 2015

(65) Prior Publication Data

US 2017/0043574 A1 Feb. 16, 2017

(51) Int. Cl.
*B41J 2/045* (2006.01)
*B41J 2/155* (2006.01)

(52) U.S. Cl.
CPC ..... *B41J 2/04528* (2013.01); *B41J 2/0458* (2013.01); *B41J 2/04541* (2013.01); (Continued)

(58) Field of Classification Search
CPC ..... B41J 11/002; B41J 2002/17569; B41J 11/0015; B41J 13/0009; B41J 2002/012; (Continued)

(56) References Cited

U.S. PATENT DOCUMENTS 5,475,405 A 12/1995 Widder et al.
7,125,110 B2 10/2006 Merz et al.
(Continued)

FOREIGN PATENT DOCUMENTS

JP 2011126047 A 6/2011

OTHER PUBLICATIONS

"Thin-film Thermal Head with Heating Resistors Having Self-controlled Temperature", Susumu Shibata et al., IEEE, Dated 1995.

*Primary Examiner* — Lamson Nguyen
(74) *Attorney, Agent, or Firm* — Mannava & Kang, P.C.

(57) ABSTRACT

According to an example, in a method for enhancing temperature distribution uniformity across a printer die, in which the printer die includes a plurality of drop generators arranged in a plurality of columns, a warming map that identifies the drop generators of the plurality of drop generators that are to be supplied with warming pulses to enhance temperature distribution uniformity across the printer die may be accessed. The warming map may identify a non-uniform distribution of the drop generators across a column of the plurality of columns. In addition, the warming map may be implemented to supply the drop generators identified in the warming map as the drop generators that are to receive the warming pulses.

20 Claims, 6 Drawing Sheets

(52) U.S. Cl.
CPC ..... *B41J 2/04563* (2013.01); *B41J 2/04596* (2013.01); *B41J 2/04598* (2013.01); *B41J 2/155* (2013.01); *B41J 2202/08* (2013.01)

(58) Field of Classification Search
CPC ..... B41J 2/04528; B41J 2/04541; B41J 2/04563; B41J 2/0458; B41J 2/155
See application file for complete search history.

(56) References Cited

U.S. PATENT DOCUMENTS

| | | | |
|---|---|---|---|
| 7,178,899 | B2 | 2/2007 | Silverbrook |
| 2008/0143775 | A1 | 6/2008 | Shihoh et al. |
| 2012/0212533 | A1 | 8/2012 | Yoshimoto |
| 2013/0093809 | A1 | 4/2013 | Kosaka et al. |
| 2013/0155142 | A1 | 6/2013 | Browning et al. |
| 2013/0335471 | A1 | 12/2013 | Murase et al. |

ENHANCING TEMPERATURE DISTRIBUTION UNIFORMITY ACROSS A PRINTER DIE

BACKGROUND

In thermal inkjet printing systems, a thermal inkjet (TIJ) printhead typically ejects printing fluid drops from a reservoir through a plurality of nozzles onto a print medium. The nozzles are typically arranged in one or more arrays or columns such that properly sequenced ejection of printing fluid from the nozzles causes intended images to be printed on a print medium as the printhead and/or print medium move relative to each other. TIJ printheads eject printing fluid drops from a nozzle by passing electrical current through a heating element, which generates heat and vaporizes a small portion of the printing fluid within a firing chamber. The rapidly expanding vapor bubble forces a small amount of printing fluid to drop out of the nozzle. When the heating element cools, the vapor bubble quickly collapses, drawing more printing fluid from the reservoir into the firing chamber.

During printing, heat from the heating elements as well as the physical configuration and thermal characteristics of the TIJ die affect the temperature of the TIJ die. For instance, the areas, e.g., ends, of the TIJ die that do not contain heating elements often act as heat sinks and thus pull heat from locations in the TIJ die containing heating elements. Thermal differences over the nozzle column area of the TIJ die have a significant influence on characteristics of the printing fluid drops being fired from the nozzles. For example, a higher die temperature results in a higher drop weight and drop velocity, while a lower die temperature results in a lower drop weight and velocity. Thus, variations in temperature across the die have been known to result in variations in drop weight, velocity and shape, which have been known to have a considerable impact on print quality. For example, drops with lower drop weight ejected from cooler areas of the die have been known to result in printed areas on the print medium that have less printing fluid than intended. The areas printed with less printing fluid will appear to be lighter than other areas printed with drops of higher drop weight ejected from warmer areas of the die. In general, print quality problems associated with inconsistent drop characteristics caused by variations in temperature across the TIJ die are referred to as light area banding (LAB), die boundary banding (DBB), and hue shift.

BRIEF DESCRIPTION OF THE DRAWINGS

Features of the present disclosure are illustrated by way of example and not limited in the following figure(s), in which like numerals indicate like elements, in which.

DETAILED DESCRIPTION

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Disclosed herein are methods for enhancing temperature distribution uniformity across a printer die and apparatuses for implementing the methods. In the methods, a warming map that identifies the drop generators of a plurality of drop generators that are to be supplied with warming pulses to enhance temperature distribution uniformity across the printer die may be accessed. The warming map may identify a non-uniform distribution of the drop generators across a column of a plurality of columns. In addition, the warming map may be implemented to supply the drop generators identified in the warming map as the drop generators that are to receive the warming pulses.

Through implementation of the methods and apparatuses disclosed herein, temperature distribution uniformity across a printer die may be enhanced. In one regard, therefore, the methods and apparatuses disclosed herein may enable the drop generators of a printer die to drop substantially equivalently sized drops of printing fluid and thus substantially enhance a print quality of the printer die.

Figure 1A:
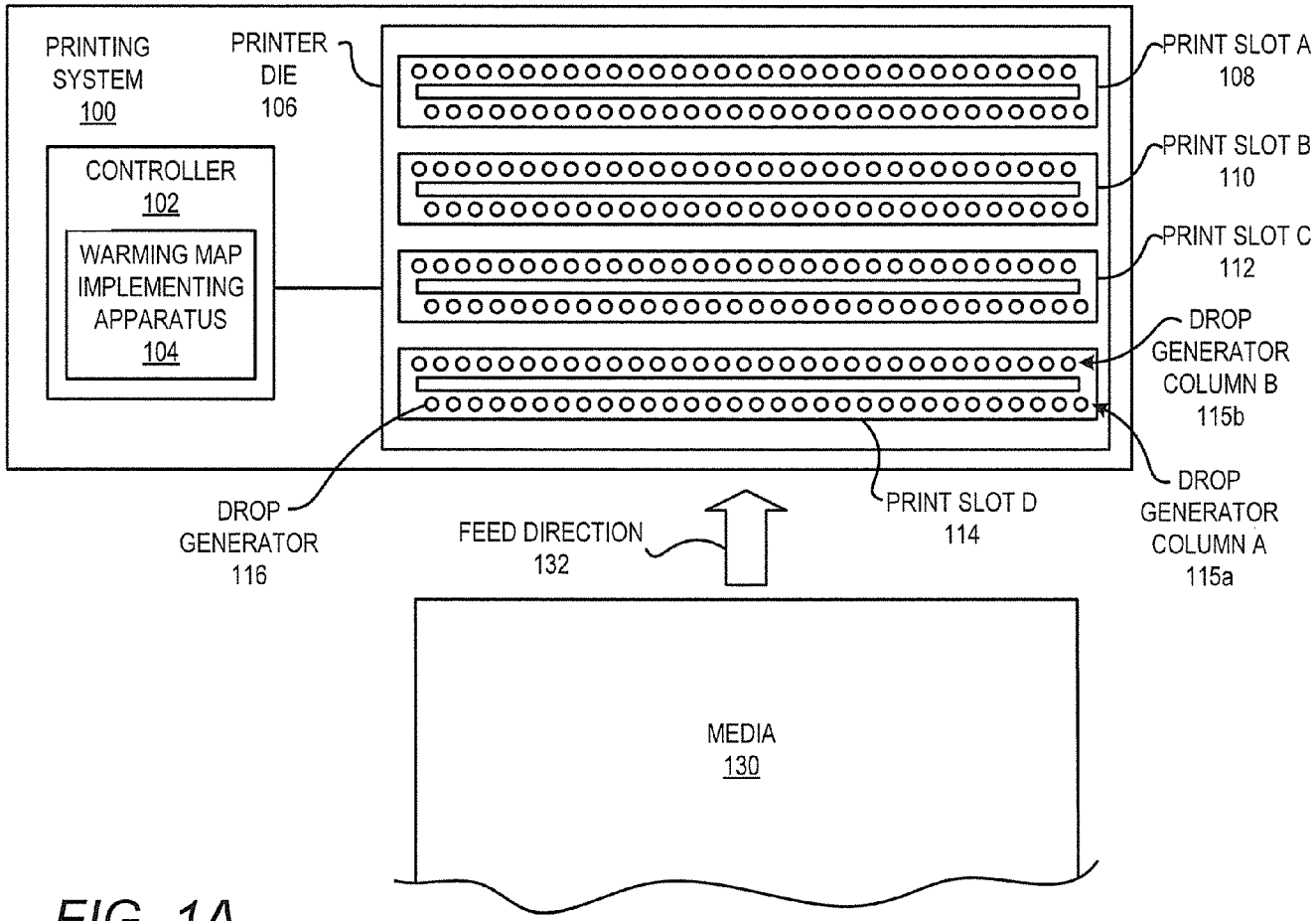
FIG. 1A is a simplified diagram of a printing system, which may implement various aspects of the methods disclosed herein, according to an example of the present disclosure.

With reference first to FIG. 1A, there is shown a simplified schematic diagram of a printing system 100, which may implement various aspects of the methods disclosed herein, according to an example. It should be understood that the printing system 100 depicted in FIG. 1A may include additional elements and that some of the elements depicted therein may be removed and/or modified without departing from a scope of the printing system 100.

As shown in FIG. 1A, the printing system 100 may include a controller 102 and a printer die 108, in which the printer die 108 includes a number of print slots 108-114. The print slots 108-114 may equivalently be denoted as printheads. Although the printing system 100 has been depicted as including a single printer die 106, the printing system 100 may include a plurality of printer die 106 arranged in series, in which the series of printer die 106 may form a module. In addition, the printing system 100 may include multiple modules that may be stacked together in a linear fashion. Each of the print slots 108-114 may be supplied with different printing fluids, such as inks, dyes, pre-treatments, varnishes, etc., to be ejected from nozzles contained in the print slots 108-114. In a particular example, each of the print slots 108-114 is supplied with different colored printing fluids. For instance, a first print slot 108 may be supplied with a black colored printing fluid, a second print slot 110 may be supplied with a cyan colored printing fluid, a third print slot 112 may be supplied with a magenta colored printing fluid, and a fourth print slot 114 may be supplied with a yellow colored printing fluid. In other examples, the printing system 100 may include additional print slots that may be supplied with differently colored printing fluids. In yet other examples, the printing system 100 may include a single print slot 106, for instance, that is to print a black colored printing fluid.

Figure 1B:
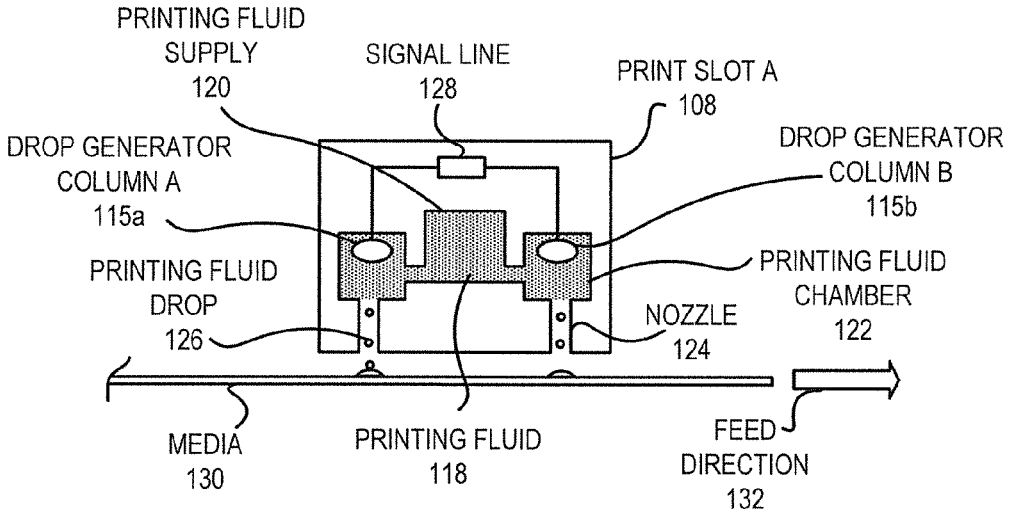
FIG. 1B is a simplified schematic diagram of a print slot depicted in FIG. 1A, according to an example of the present disclosure.

Each of the print slots 108-114 is depicted as including a plurality of drop generators 116 arranged along two parallel columns. The drop generators 116 are depicted as being arranged along a first drop generator column 115*a* and a second drop generator column 115*b*. A relatively small number of drop generators 116 is shown for convenience, but it should be clearly understood that each of the print slots 108-114 may include much larger numbers of drop generators 116, for instance, to be able to print at 600 dpi or more across the width of a media 130. Each of the drop generators 116 may be a resistor (or equivalently, a heating element) that may be energized to cause drops of printing fluid to be ejected out of respective nozzles (an example is shown in FIG. 1B). That is, for instance, the drop generators 116 may be supplied with an ejection pulse to cause the printing fluid to be vaporized, thus forming a bubble that causes the printing fluid to be ejected. The ejection pulse may include both a precursor pulse and a firing pulse.

As discussed in greater detail herein below, the controller 102 also includes a warming map implementing apparatus 104 that is to access a warming map that identifies the drop generators 116 of the printer die 106 that are to be supplied with warming pulses to warm the printer die during a warming operation, in which the warming map identifies a non-uniform distribution of the drop generators 116 across a column of the plurality of columns that are to be supplied with the warming pulses. The warming pulse may include a precursor pulse without a firing pulse. As discussed herein, a distribution of drop generators 116 across a column 115*a* of drop generators 116 that are to be supplied with the warming pulses may be construed as being non-uniform when a larger number of drop generators 116 in a particular section of the drop generators 116 as compared with the number of drop generators 116 in another section are included in the distribution of the drop generators that are to be supplied with the warming pulses. Thus, for instance, a distribution in which every other drop generator 116 along a column of drop generators 116 is identified in a warming map to receive warming pulses during a warming operation may be construed as being a warming map having a uniform distribution of drop generators 116 that are to be supplied with warming pulses.

In addition, the warming map implementing apparatus 104 may supply the drop generators 116 identified in the warming map as drop generators that are to receive warming pulses during a warming operation with the warming pulses during the warming operation. According to an example, the warming map implementing apparatus 104 supplies the drop generators 116 identified in the warming map with warming pulses, e.g., supplies precursor pulses without supplying firing pulses. As such, the warming map implementing apparatus 104 may not supply the drop generators 116 identified in the warming map with firing pulses to cause printing fluid to be ejected out of nozzles during a warming operation. Instead, the duration of the pulses supplied to the drop generators 116 identified in the warming map may only be sufficient to heat printing fluid, and thus a section of printer die 106, around the identified drop generators 116.

As also shown in FIG. 1A, the drop generators 116 are to drop printing fluid onto the media 130 as either the media 130 is fed past the print slots 108-114 in the feed direction 132 or the drop generators 116 are moved over the media 130 in a direction opposite the feed direction 132. In either arrangement, any given location on the media 130 may receive printing fluid from the same drop generator 116 and thus, the printing system 100 may be construed as being a page wide printing system. In this example, the printer die 106 may not be scanned in a direction perpendicular to the feed direction 132 during a printing operation. In other examples, the printer die 106 may be scanned in a scanning direction along a direction perpendicular to the feed direction 132 during printing operations, and thus, the printing system 100 may be construed as being a scanning type of printing system. In addition, although particular reference is made throughout the present disclosure that the media 130 is fed in the feed direction 132, it should be understood that the print slots 108-114 may equivalently be moved in the direction opposite the feed direction 132 without departing from a scope of the methods and apparatuses disclosed in the present disclosure.

Turning now to FIG. 1B, there is shown a simplified schematic diagram of a print slot 108, according to an example. It should be understood that the other print slots 110-114 may have similar configurations as the print slot 108 depicted in FIG. 1B. It should also be understood that the print slot 108 depicted in FIG. 1B may include additional elements and/or that the elements depicted therein may be removed and/or modified without departing from a scope of the print slot 108.

As shown in FIG. 1B, the print slot 108 may include multiple drop generators 116, for instance, arranged along two substantially parallel columns 115*a*, 115*b* (two of the drop generators 116 are shown in FIG. 1B). In addition, the drop generators 116 may receive printing fluid 118 from a printing fluid supply 120 that may be connected to a printing fluid reservoir (not shown). Particularly, printing fluid 118 from the printing fluid supply 120 may be supplied into a printing fluid chamber (or equivalently, a firing chamber) 122 and application of ejection pulses on a drop generator 116 may cause a printing fluid drop 126 to be ejected through a nozzle 124 and onto the media 130. As shown in FIG. 1B, the nozzles 124 on opposite sides of the printing fluid supply 120 may have approximately the same widths with respect to each other.

Figure 1C:
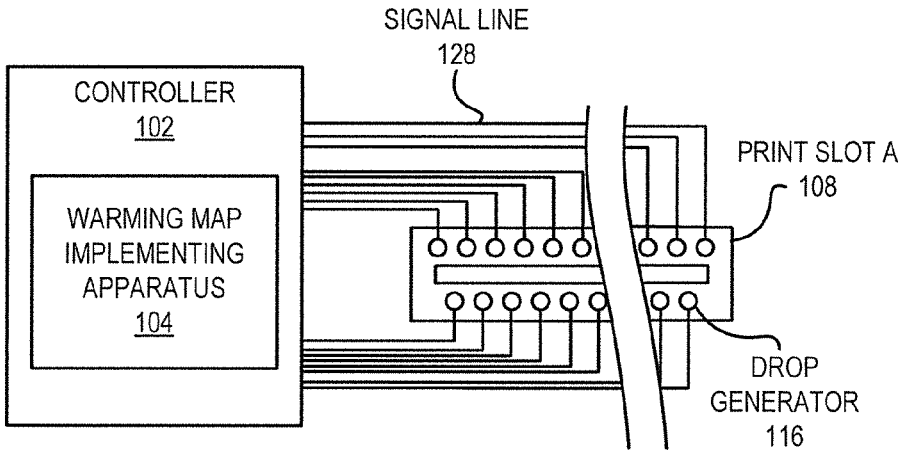
FIG. 1C is a simplified schematic diagram of a manner in which signal lines shown in FIG. 1B may be connected between a controller and drop generators, according to an example of the present disclosure.

According to an example, the drop generator 116 is a resistor that is energized, e.g., heated, through receipt of an electrical signal through a signal line 128. A simplified example of a manner in which signal lines 128 may be connected between the controller 102 and the drop generators 116, according to an example, is depicted in FIG. 1C. It should, however, be understood that the controller 102 may control the transmission of electrical signals to each of the drop generators 116 through use of other mechanisms, for instance, multiplexers, etc.

Particularly, during a printing operation, the drop generator 116 may receive an ejection pulse, e.g., both a precursor pulse and a firing pulse, to cause a bubble to be formed in the printing fluid 118 contained in the printing fluid chamber 122, which may cause a printing fluid drop 126 to be ejected through the nozzle 124. During a warming operation, the drop generator 116 may receive a warming pulse, e.g., a precursor pulse without a firing pulse. As such, during the warming operation, the drop generator 116 may heat the printing fluid 118 in the printing fluid chamber 122 without causing a printing fluid drop 126 from being ejected through the nozzle 124. The heating of the printing fluid 118 may also cause areas in the printer die 106 that are near the heated printing fluid 118 to also become heated. As discussed herein, the drop generators 116 that are supplied with the warming pulses to thus heat intended areas of the printer die 106 are identified in a warming map. In addition, because a non-uniform temperature distribution may exist across a printer die 106, the warming map may identify a non-uniform distribution of drop generators 116 that are to receive the warming pulses. That is, for instance, the warming map may identify the drop generators 116 that are located near areas of the printer die 106 that have relatively lower temperatures as the drop generators that are to be supplied with the warming pulses.

By way of particular example in which heat is known to be dissipated at a faster rate at the ends of the printer die 106 and thus the ends of the printer die 106 have relatively lower temperatures than the middle section of the printer die 106, the warming map may include a larger number of drop generators 116 that are to be supplied with the warming pulses at the ends of the printer die 106 as compared with the number of drop generators 116 located near the middle section of the printer die 106. Furthermore, the warming map may indicate that only the drop generators 116 located at the ends of the printer die 106 are to be supplied with the warming pulses and that the drop generators 116 located near the middle of the printer die 106 are not to receive the warming pulses during a warming operation.

During a printing operation, the controller 102 may selectively activate the drop generators 116 according to a proper sequence as the media 130 is fed in the feed direction 132 to cause printing fluid drops 126 to be dropped at the appropriate locations on the media 130. According to an example, the controller 102 may also cause the printer die 106 to be scanned in a direction perpendicular to the feed direction 132 during a printing operation. In addition, the drop generators 116 may be selectively energized to form a desired image on the media 130. The desired image may include any of text, pictures, lines, drawings, filled-in drawings, etc.

Figure 2:
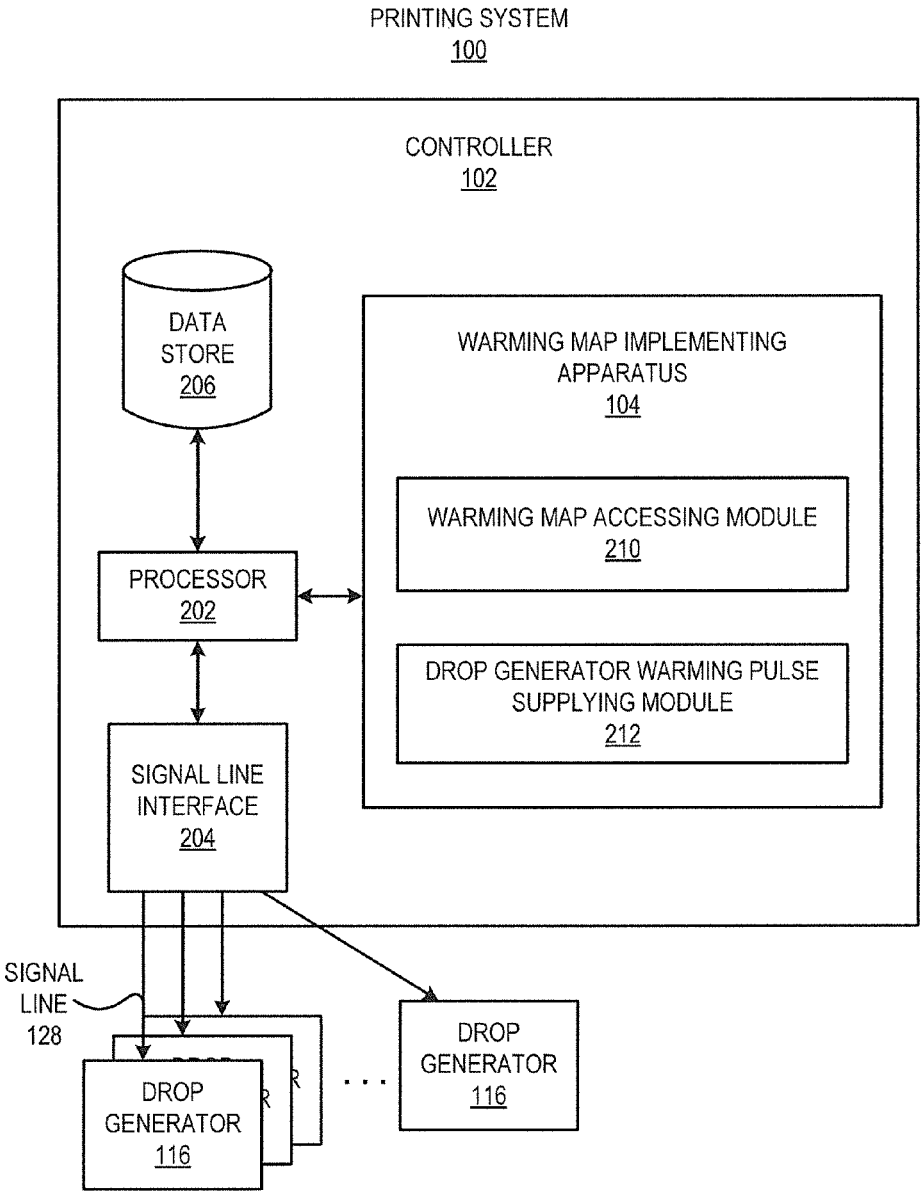
FIG. 2 is a simplified block diagram of the printing system shown in FIG. 1A, according to an example of the present disclosure.

Turning now to FIG. 2, there is shown a simplified block diagram of the printing system 100, according to an example. It should be understood that the printing system 100 depicted in FIG. 2 may include additional elements and that some of the elements depicted therein may be removed and/or modified without departing from a scope of the printing system 100.

As shown in FIG. 2, the controller 102 is depicted as including, in addition to the warming map implementing apparatus 104, a processor 202, a signal line interface 204, and a data store 206. The warming map implementing apparatus 104 is also depicted as including a warming map accessing module 210 and a drop generator warming pulse supplying module 212. Although not shown, the controller 102 may further include an interface to an actuator (not shown) that is to control feeding of the media 130, an actuator that is to control scanning of a carriage on which the printer die 106 is positioned, etc.

The processor 202, which may be a microprocessor, a micro-controller, an application specific integrated circuit (ASIC), or the like, is to perform various processing functions in the controller 102. The processing functions may include invoking or implementing the warming map implementing apparatus 104 and particularly, the modules 210 and 212 of the warming map implementing apparatus 104, as discussed in greater detail herein below. According to an example, the warming map implementing apparatus 104 is a hardware device on which is stored various sets of machine readable instructions. The warming map implementing apparatus 104 may be, for instance, a volatile or non-volatile memory, such as dynamic random access memory (DRAM), electrically erasable programmable read-only memory (EEPROM), magnetoresistive random access memory (MRAM), memristor, flash memory, floppy disk, a compact disc read only memory (CD-ROM), a digital video disc read only memory (DVD-ROM), or other optical or magnetic media, and the like, on which software may be stored. In this example, the modules 210 and 212 may be software modules, e.g., sets of machine readable instructions, stored in the warming map implementing apparatus 104.

In another example, the warming map implementing apparatus 104 may be a hardware component, such as a chip, an integrated circuit, etc., and the modules 210 and 212 may be hardware modules on the hardware component. In a further example, the modules 210 and 212 may include a combination of software and hardware modules. In a yet further example, the processor 202 may be an ASIC that is to perform the functions of the modules 210 and 212. In this example, the processor 202 and the warming map implementing apparatus 104 may be a single processing apparatus.

The processor 202 may store data in the data store 206 and may use the data in implementing the modules 210 and 212. For instance, the processor 202 may store data pertaining to an image that is to be printed onto a medium 130. In any regard, the data store 206 may be volatile and/or non-volatile memory, such as DRAM, EEPROM, MRAM, phase change RAM (PCRAM), memristor, flash memory, and the like. In addition, or alternatively, the data store 206 may be a device that may read from and write to a removable media, such as, a floppy disk, a CD-ROM, a DVD-ROM, or other optical or magnetic media.

The signal line interface 204 may include hardware and/or software to enable the processor 202 to respectively send electrical signals to the drop generators 116 over signal lines 128. Although not shown, the signal line interface 204 may be connected to a power source from which the electrical signals may be transmitted to the respective drop generators 114. In addition, the processor 202 may be connected to an input/output interface (not shown) that may enable the processor 202 to access a network, such as an internal network, the Internet, etc., over which the processor 202 may receive files containing images to be printed. The input/output interface may include a network interface card and/or may also include hardware and/or software to enable the processor 202 to communicate with various input and/or output devices, such as a keyboard, a mouse, a display, another computing device, etc., through which a user may input instructions into the printing system 100.

Figure 3:
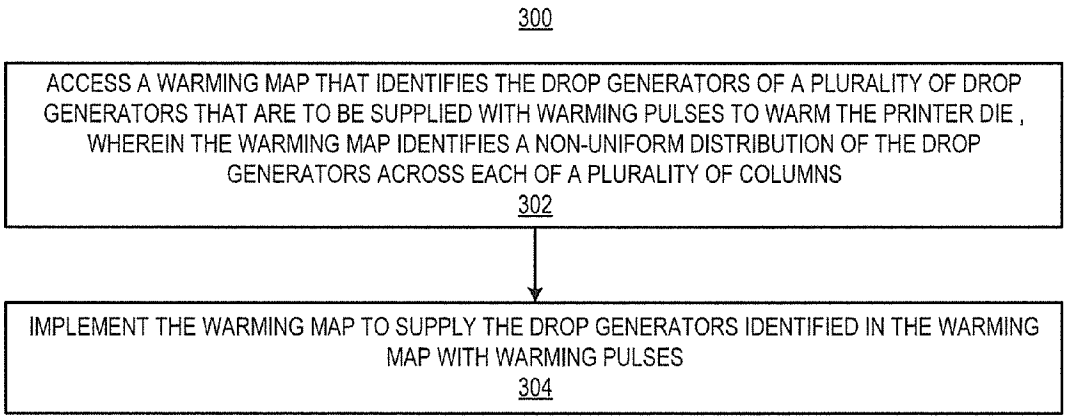
FIG. 3 is a flow diagram of a method for enhancing temperature distribution uniformity across a printer die, according to examples of the present disclosure.

Various manners in which the processor 202 in general, and the modules 210 and 212 in particular, may be implemented are discussed in greater detail with respect to the method 300 depicted in FIG. 3. Particularly, FIG. 3 depicts a flow diagram of a method 300 for enhancing temperature distribution uniformity across a printer die 106, according to an example. It should be apparent to those of ordinary skill in the art that the method 300 may represent generalized illustrations and that other operations may be added or existing operations may be removed, modified, or rearranged without departing from the scope of the method 300. Generally speaking, the processor 202 depicted in FIG. 2 may implement method 300 through implementation of at least some of the modules 210 and 212.

The description of the method 300 is made with reference to the printing system 100 illustrated in FIGS. 1A-2 for purposes of illustration. It should, however, be clearly understood that printing systems having other configurations may be implemented to perform the method 300 without departing from the scope of the method 300.

With reference to the method 300 depicted in FIG. 3, at block 302, a warming map that identifies the drop generators 116 that are to be supplied with warming pulses to enhance temperature distribution uniformity across the printer die 106 may be accessed. As discussed herein, the warming map may identify a non-uniform distribution of the drop generators 116 across a column of the plurality of columns. Various examples of non-uniform distributions are discussed in greater detail herein below.

According to an example, the warming map accessing module 210 may access the warming map from the data store 206. In another example, the warming map may be firmware and the warming map accessing module 210 may access the warming map, which may be hardcoded on the warming map implementing apparatus 104.

At block 304, the warming map may be implemented to supply the drop generators 116 identified in the warming map as the drop generators that are to receive the warming pulses. Particularly, the drop generator warming pulse supplying module 212 may supply the drop generators 116 identified in the warming map as the drop generators that are to receive the warming pulses over respective signal lines 128. The warming pulses may be a continuous series of pulses that have pulse widths of sufficiently short durations so that the energy of the pulses is insufficient to cause a deposition of a printing fluid drop from a nozzle 124 of a print slot 108. By way of particular example, a warming pulse may have a duration of around 400 nanoseconds, whereas a firing pulse, which is of sufficient duration to cause a printing fluid drop 126 to be dropped, may have a duration of around 1000 nanoseconds. In addition, an ejection pulse may include a precursor pulse having a duration of around 400 nanoseconds with a delay of about 600 nanoseconds between the precursor pulse and the firing pulse.

Figure 4:
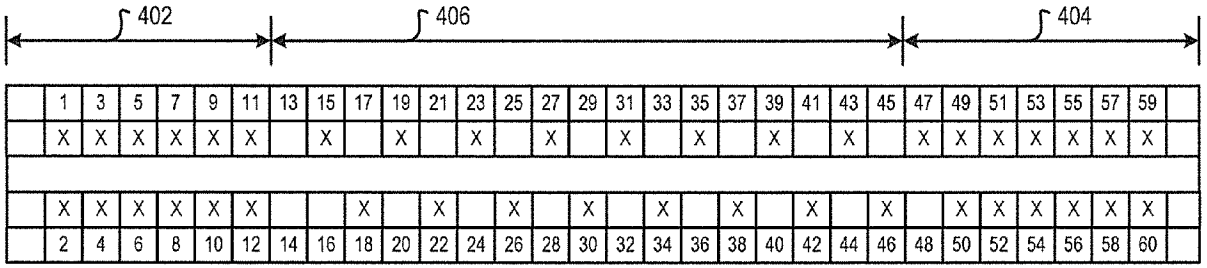
FIGS. 4-6 are respective diagrams of warming maps, according to examples of the present disclosure.
Figure 5:
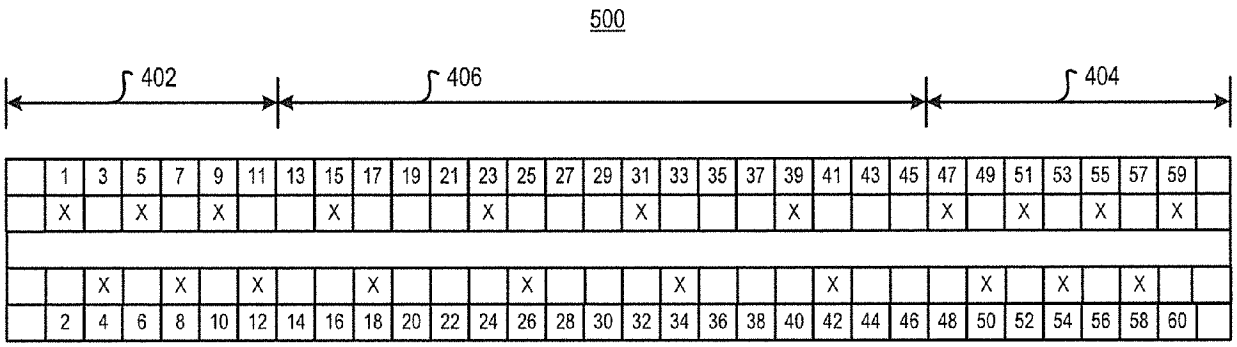
Figure 6:
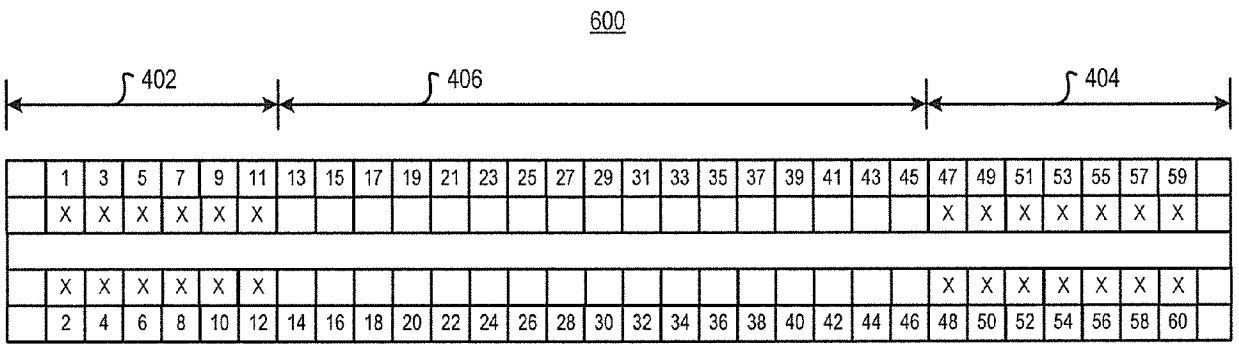

Turning now to FIGS. 4-6, there are shown warming maps 400-600 that respectively identify non-uniform distributions of the drop generators 116 that are to receive warming pulses across two columns 115*a*, 115*b* of a printer die 106 according to various examples. It should be clearly understood that the warming maps 400-600 are not exhaustive of the warming maps that may be implemented in the methods and apparatuses disclosed herein. Instead, it should be understood that warming maps having other non-uniform distributions of the drop generators 116 that are to receive warming pulses during a warming operation may be implemented.

In FIGS. 4-6, the numbers 1-60 represent either individual drop generators 116 or primitives, in which each of the primitives includes a plurality of drop generators 116, and the locations of the numbers represent a physical location across a printer die 106. Thus, for instance, the numbers 1-12 may correspond to a left (first) end of the printer die 106, the numbers 47-60 may correspond to a right (second) end of the printer die 106, and the numbers 13-44 may correspond to a middle section of the printer die 106. By way of example, each of the primitives includes a group of 11 drop generators 116. For purposes of convenience, reference herein to drop generators 116 should be construed as additionally or alternatively referencing primitives.

Although the warming maps in FIGS. 4-6 are depicted as including 60 drop generators 116, it should be understood that the warming maps may include any reasonably suitable number of drop generators 116 (or primitives) without departing from a scope of the methods and apparatuses disclosed herein. Moreover, the "X" corresponding to a number indicates that that drop generator 116 is to be supplied with warming pulses during a warming operation.

According to an example, the warming maps 400-600 may be generated through testing of the performance of the drop generators 116. That is, a set of printing fluid printed by the printer die 106 may be examined to determine which of the drop generators 116 may have deposited relatively smaller drops of printing fluid as compared with the other drop generators 116. Those drop generators 116 that have deposited relatively smaller drops of material may be identified in a warming map as being the drop generators 116 that are to be supplied with warming pulses during a warming operation. As another example, the warming maps 400-600 may be generated through thermal imaging of the printer die 106, for instance, following a printing operation, to identify areas of lower temperature and the drop generators 116 located near the areas of lower temperature may be identified in a warming map as being the drop generators 116 that are to be supplied with warming pulses during a warming operation. In one regard, therefore, the warming map may differ for different types of printing systems, different print-modes of a printing system, etc. In addition, the warming maps for printer die 106 that are formed of different types of materials, e.g., ceramic, plastic, etc., may differ from each other.

With reference first to FIG. 4, in the warming map 400, a larger number of the drop generators 116 located near the ends 402 and 404 of the printer die 106 as compared with the drop generators 116 located in the middle section 406 are designated to receive the warming pulses during a warming operation. In the warming map 400, therefore, the drop generators 116 located at various positions across the width of the printer die 116 may be supplied with warming pulses during a warming operation.

Turning now to FIG. 5, the warming map 500 is similar to the warming map 400 depicted in FIG. 4, but includes a relatively smaller number of drop generators 116 that are to be supplied with the warming pulses during a warming operation as compared with the warming map 400. In one regard, the warming map 500 may require a lower peak power needed to warm the printer die 106 as compared with the warming map 400. In addition, the warming map 500 may cause the warming operation to be performed more often, which may cause the warming map implementing apparatus 104 to remain active for a longer period of time during a printing operation, which may also help enhance temperature distribution uniformity across the printer die 106.

With reference to FIG. 6, only the drop generators 116 located at the ends 402 and 404 of the printer die 106 are identified in the warming map 600 as being the drop generators 116 that are to be supplied with warming pulses during a warming operation. In this example, therefore, the drop generators 116 located at the middle section 406 of the printer die 106 are not to receive warming pulses during a warming operation.

In other examples, the warming map may include a different distribution of the drop generators 116 located along a first column 115*a* of a print slot 108 as compared with the drop generators 116 located along a second column 115*b* of the print slot 108.

As discussed above with respect to FIG. 1A, the printer die 106 may include a number of print slots 108-114, in which each of the print slots 108-114 is to print a differently colored printing fluid. According to an example, the method 300 is implemented separately for each of the print slots 108-114. That is, a warming map for the drop generators 116 in each of the print slots 108-114 may be accessed and implemented. In one example, the same warming map may be accessed and implemented for the drop generators 116 in each of the print slots 108-114.

In another example, a first warming map may be accessed and implemented for the drop generators 116 in one of the print slots 108-114 and a second warming map be accessed and implemented for the drop generators 116 in another one of the print slots 108-114, in which the second warming map differs from the first warming map. In this example, for instance, the warming maps for the print slots 108 and 114 located near the top and bottom of the printer die 106 may have a larger number of drop generators 116 that are to receive the warming pulses than the warming maps for the print slots 110 and 112 located near the middle of the printer die 106 that are to be supplied with the warming pulses during a warming operation.

According to another example, at block 302, the warming map accessing module 210 may access a warming map from a plurality of available warming maps to which the warming map accessing module 210 may have access. For instance, the warming map accessing module 210 may have access to each of the warming maps 400-600. In this example, each of the available warming maps may identify a different non-uniform distribution of drop generators 116. By way of example, the warming map accessing module 210 may access a first warming map to be implemented during a warming operation that is performed prior to performing a printing operation and may access a second warming map to be implemented during warming operation that is performed during a printing operation. As another example, the warming map accessing module 210 may access a first warming map to be implemented for a first type of print mode and a second warming map to be implemented for a second type of print mode. As a yet further example, the warming map accessing module 210 may access a first warming map when the printing system 100 is to print graphics and to access a second warming map when the printing system 100 is to print text. As a further example, the warming map accessing module 210 may automatically switch between different warming maps in order to achieve the highest level of temperature distribution uniformity. In this example, the decision as to which warming map to implement may be based upon a running drop generator 116 firing history, data obtained by local temperature sensors, etc.

Some or all of the operations set forth in the method 300 may be contained as utilities, programs, or subprograms, in any desired computer accessible medium. In addition, the method 300 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Figure 7:
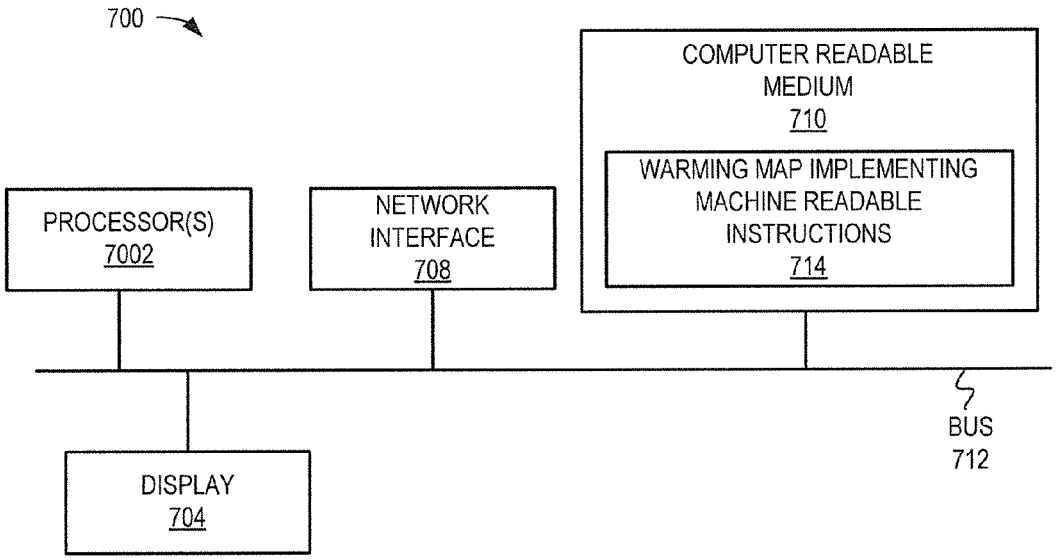
FIG. 7 is schematic representation of a computing device, which may be employed to perform various functions of the controller depicted in FIG. 2, according to an example of the present disclosure.

Turning now to FIG. 7, there is shown a schematic representation of a computing device 700, which may be employed to perform various functions of the controller 102 depicted in FIG. 2, according to an example. The computing device 700 may include a processor 702, a display 704, such as a monitor; a network interface 708, such as a Local Area Network LAN, a wireless 802.11x LAN, a 3G mobile WAN or a WiMax WAN; and a computer-readable medium 710. Each of these components may be operatively coupled to a bus 712. For example, the bus 712 may be an EISA, a PCI, a USB, a FireWire, a NuBus, or a PDS.

The computer readable medium 710 may be any suitable medium that participates in providing instructions to the processor 702 for execution. For example, the computer readable medium 710 may be non-volatile media, such as an optical or a magnetic disk; volatile media, such as memory. The computer-readable medium 710 may also store a warming map implementing machine readable instructions 714, which may perform the method 300 and may include the modules 210 and 212 of the warming map implementing apparatus 104 depicted in FIG. 2. In this regard, the warming map implementing machine readable instructions 714 may include a warming map accessing module 210 and a drop generator warming pulse supplying module 212.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A method for enhancing temperature distribution uniformity across a printer die, wherein the printer die comprises a plurality of drop generators arranged in a plurality of columns, said method comprising:

accessing a warming map from a plurality of available warming maps based upon at least one of a running drop generator activation history and local temperatures on the printer die, wherein each of the plurality of available warming maps identifies a different non-uniform distribution of the drop generators of the plurality of drop generators that are to be supplied with warming pulses to enhance temperature distribution uniformity across the printer die, wherein the accessed warming map identifies a non-uniform distribution of the drop generators that are to be supplied with warming pulses across a column of the plurality of columns; and implementing the warming map to supply warming pulses to the drop generators identified in the accessed warming map as the drop generators that are to receive the warming pulses.

2. The method according to claim 1, wherein the printer die comprises a first end, a second end, and a middle section, and wherein the non-uniform distribution of the drop generators includes a larger number of the drop generators near the first end and the second end as compared with the middle section that are to be supplied with warming pulses.

3. The method according to claim 2, wherein the non-uniform distribution of the drop generators that are to be supplied with warming pulses includes a distribution of the drop generators that includes only the drop generators located at the first end and the second end.

4. The method according to claim 1, wherein the plurality of columns comprises a first column and a second column along a width of the printer die, wherein the drop generators arranged along the first column are arranged substantially parallel to the drop generators arranged along the second column, and wherein the non-uniform distribution of the drop generators includes a different distribution of drop generators along the first column that are to be supplied with warming pulses as compared with the second column.

5. The method according to claim 1, wherein the printer die comprises a plurality of print slots, wherein each of the plurality of print slots includes a pair of columns of the plurality of columns, wherein accessing the warming map further comprises accessing a plurality of warming maps, and wherein each of the plurality of warming maps corresponds to the columns of drop generators in a respective one of the plurality of print slots.

6. The method according to claim 5, wherein a first warming map of the plurality of warming maps differs from a second warming map of the plurality of warming maps.

7. The method according to claim 5, wherein the columns of the plurality of print slots are arranged in parallel and in an aligned arrangement with respect to each other, wherein a first print slot of the plurality of print slots is positioned at a bottom location of the printer die, a second print slot of the plurality of print slots is positioned at a top location of the printer die, and a third print slot of the plurality of print slots is positioned between the first print slot and the second print slot, wherein a first warming map corresponds to the first print slot, a second warming map corresponds to the second print slot, and a third warming map corresponds to the third print slot, and wherein the first warming map includes a larger number of drop generators that are to be supplied with the warming pulses as compared to the third warming map.

8. The method according to claim 1, wherein accessing the warming map further comprises accessing the warming map at least one of before or during a printing operation.

9. An apparatus for enhancing temperature distribution uniformity across a printer die, said apparatus comprising:

a warming map accessing module that accesses a warming map that identifies the drop generators of the plurality of drop generators that are to be supplied with warming pulses to enhance temperature distribution uniformity across the printer die, wherein the warming map identifies a non-uniform distribution of the drop generators that are to be supplied with warming pulses across a column of a plurality of columns, wherein the plurality of columns comprises a first column and a second column along a width of the printer die, wherein the drop generators arranged along the first column are arranged substantially parallel to the drop generators arranged along the second column, and wherein the non-uniform distribution of the drop generators includes a different distribution of drop generators along the first column that are to be supplied with warming pulses as compared with the second column; and a drop generator warming pulse supplying module that implements the accessed warming map in supplying warming pulses to the drop generators identified in the warming map as drop generators that are to be supplied with the warming pulses.

10. The apparatus according to claim 9, wherein the printer die comprises a plurality of print slots, wherein each of the plurality of print slots includes a pair of columns of the plurality of columns, wherein accessing the warming map further comprises accessing a plurality of warming maps, wherein each of the plurality of warming maps corresponds to the columns of drop generators in a respective one of the plurality of print slots, and wherein a first warming map of the plurality of warming maps differs from a second warming map of the plurality of warming maps.

11. The apparatus according to claim 9, wherein the warming map accessing module further accesses a warming map from a plurality of available warming maps, and wherein each of the plurality of available warming maps identifies a different non-uniform distribution of the drop generators that are to be supplied with warming pulses.

12. The apparatus according to claim 9, wherein the printer die comprises a plurality of print slots, wherein each of the plurality of print slots includes a pair of columns of the plurality of columns, wherein a plurality of warming maps are accessed, and wherein each of the plurality of warming maps corresponds to the columns of drop generators in a respective one of the plurality of print slots.

13. The apparatus of claim 12, wherein the columns of the plurality of print slots are arranged in parallel and in an aligned arrangement with respect to each other, wherein a first print slot of the plurality of print slots is positioned at a bottom location of the printer die, a second print slot of the plurality of print slots is positioned at a top location of the printer die, and a third print slot of the plurality of print slots is positioned between the first print slot and the second print slot, wherein a first warming map corresponds to the first print slot, a second warming map corresponds to the second print slot, and a third warming map corresponds to the third print slot, and wherein the first warming map includes a larger number of drop generators that are to be supplied with the warming pulses as compared to the third warming map.

14. The apparatus according to claim 9, wherein the non-uniform distribution of the drop generators that are to be supplied with warming pulses includes a distribution of the drop generators that includes only the drop generators located at the first end and the second end.

15. A non-transitory computer readable storage medium on which is stored machine readable instructions that when executed by a processor cause the processor to:

access a warming map that identifies drop generators of a plurality of drop generators that are to be supplied with warming pulses to enhance temperature distribution uniformity across a printer die containing the plurality of drop generators, wherein the warming map identifies a non-uniform distribution of the drop generators that are to be supplied with warming pulses across a column of a plurality of columns, wherein the plurality of columns comprises a first column and a second column along a width of the printer die, wherein the drop generators arranged along the first column are arranged substantially parallel to the drop generators arranged along the second column, and wherein the non-uniform distribution of the drop generators includes a different distribution of drop generators along the first column that are to be supplied with warming pulses as compared with the second column; and implement the warming map to supply warming pulses to the drop generators identified in the warming map as the drop generators that are to receive the warming pulses.

16. The non-transitory computer readable storage medium according to claim 15, wherein the non-uniform distribution of the drop generators further includes a larger number of the drop generators near a first end and a second end as compared with a middle section of the printer die that are to be supplied with warming pulses.

17. The non-transitory computer readable storage medium according to claim 15, wherein the instructions that when executed further cause the processor to:

access the warming map from a plurality of available warming maps, wherein each of the plurality of available warming maps identifies a different non-uniform distribution of the drop generators.

18. The non-transitory computer readable storage medium according to claim 17, wherein the instructions that when executed further cause the processor to:

access the warming map from the plurality of available warming maps based upon at least one of a running drop generator activation history and local temperatures on the printer die.

19. The non-transitory computer readable storage medium according to claim 15, wherein the printer die comprises a plurality of print slots, wherein each of the plurality of print slots includes a pair of columns of the plurality of columns, wherein a plurality of warming maps are accessed, and wherein each of the plurality of warming maps corresponds to the columns of drop generators in a respective one of the plurality of print slots.

20. The non-transitory computer readable storage medium according to claim 19, wherein the columns of the plurality of print slots are arranged in parallel and in an aligned arrangement with respect to each other, wherein a first print slot of the plurality of print slots is positioned at a bottom location of the printer die, a second print slot of the plurality of print slots is positioned at a top location of the printer die, and a third print slot of the plurality of print slots is positioned between the first print slot and the second print slot, wherein a first warming map corresponds to the first print slot, a second warming map corresponds to the second print slot, and a third warming map corresponds to the third print slot, and wherein the first warming map includes a larger number of drop generators that are to be supplied with the warming pulses as compared to the third warming map.

* * * * *